United States Patent [19]

Galasso et al.

[11] 4,056,598

[45] Nov. 1, 1977

[54] PROCESS FOR FORMING FILAMENTS FROM POLYAMIC ACID

[75] Inventors: Francis S. Galasso, Manchester; Romeo G. Bourdeau, South Windsor; Roscoe A. Pike, Simsbury, all of Conn.

[73] Assignee: United Technologies Corporation, Hartford, Conn.

[21] Appl. No.: 531,633

[22] Filed: Dec. 11, 1974

[51] Int. Cl.[2] ..... D01F 7/00

[52] U.S. Cl. ..... 264/184; 264/236; 423/447.2

[58] Field of Search ..... 264/184, 236; 260/49, 260/47 CP, 78 TF; 428/397; 423/447.2

[56] References Cited

U.S. PATENT DOCUMENTS

| | | | |
|---|---|---|---|
| 3,179,614 | 4/1965 | Edwards | 260/78 TF |
| 3,179,630 | 4/1965 | Endry | 260/78 TF |
| 3,179,633 | 4/1965 | Endry | 260/78 TF |
| 3,528,937 | 9/1970 | Reynolds et al. | 264/184 |
| 3,529,051 | 9/1970 | Buckley et al. | 260/47 CP |
| 3,803,081 | 4/1974 | Lubowitz | 260/78 TF |
| 3,812,159 | 5/1974 | Lubowitz | 260/49 |
| 3,985,934 | 10/1976 | Farrissey et al. | 428/397 |

FOREIGN PATENT DOCUMENTS

| | | | |
|---|---|---|---|
| 44-20111 | 8/1969 | Japan | 260/78 TF |

*Primary Examiner*—Jay H. Woo
*Attorney, Agent, or Firm*—John D. Del Ponti

[57] ABSTRACT

A process for producing continuous filaments from polyamic acid suitable for conversion to polyimide filaments comprising providing a starting solution consisting essentially of equimolar amounts of P,P-diaminophenyl ether and bis-(3,4-dicarboxyphenyl) sulfone dianhydride, the remainder a solvent selected from the group consisting of dimethylformamide, methyl pyrrolidone and mixtures thereof, said starting solution having a viscosity ranging from 500 to 5,000 centipoises preferably 1,500 to 3,000 centipoises, and forming the starting solution into filaments by extruding it in a coagulating bath consisting essentially of a liquid selected from the group consisting of propanol, methyl alcohol, ethyl alcohol, butyl alcohol, a mixture of ethyl alcohol and propanol and a mixture of methyl alcohol and acetone.

4 Claims, No Drawings

PROCESS FOR FORMING FILAMENTS FROM POLYAMIC ACID

BACKGROUND OF THE INVENTION

Various techniques are known for producing filaments convertible into polyimide filaments from a diversity of starting materials. At present, much attention is being focused on the production of continuous monofilaments from various polymers convertible into carbon for use as a substrate material. The prior art has indicated, for example, that filaments suitable for conversion to polyimide filaments may be made by spinning an aqueous solution of an organic base salt of a polyamic acid of a diprimary diamine and a tetracarboxylic acid which is capable of forming a dianhydride into an aqueous or water miscible coagulant bath which chemically interacts with the organic base salt to regenerate the polyamide acid or otherwise convert the salt into an insoluble form. See, for example, U.S. Pat. No. 3,529,051.

It has now been found that by selecting the proper polyamic acid and wet spinning it into a preselected coagulating bath, a simple and extremely effective process for forming superior filaments of polyamic acid suitable for conversion to polyimide filaments may be produced.

SUMMARY OF THE INVENTION

This invention relates to a method for producing filaments of polyamic acid suitable for conversion to polyimide monofilaments or yarn. More particularly, the invention relates to a process for producing such filaments from polyamic acid by a wet spinning technique.

The present invention contemplates the employment of a starting solution of polyamic acid and a solvent, wherein the polyamic acid consists essentially of essentially equimolar amounts of P,P-diaminophenyl ether and bis-(3,4-dicarboxyphenyl) sulfone dianhydride and an amount of solvent selected from the group consisting of dimethyformamide, n-methyl pyrrolidone and mixtures thereof sufficient to bring the viscosity of the starting solution to 500 to 5,000 centipoises, preferably 1,500 to 3,000 centipoises. The starting solution is extruded through an orifice directly into a coagulating bath selected from the group consisting of propanol, methyl alcohol, ethyl alcohol, butyl alcohol, a mixture of ethyl alcohol and propanol and a mixture of methyl alcohol and acetone.

DESCRIPTION OF THE PREFERRED EMBODIMENT

In the practice of the present invention it has been found that satisfactory filaments may be produced when the fiber-forming solution is a polyamic acid solution containing essentially equimolar amounts of P,P-diaminophenyl ether and bis-(3,4-dicarboxyphenyl) sulfone dianhydride, and an amount of solvent selected from the group consisting essentially of dimethyformamide, n-methyl pyrrolidone and mixtures thereof sufficient to provide a viscosity to the starting solution of 500 to 5,000 centipoises, preferably 1,500 to 3,000 centipoises. Although there may be some variation from equimolar in the ratio of the ether to the dianhydride, such variation is relatively small. The term "essentially equimolar" is meant to define such variation and is intended to cover a ratio range of approximately 0.95 to 1.05. The polyamic acid may be made by any suitable technique such as, for example, that described in U.S. Pat. No. 3,179,614 which disclosure is herein incorporated by reference or it may be purchased on the commercial market from duPont under the trade name 9520-162.

Whether the polyamic acid is prepared in the laboratory or obtained commercially, viscosity must be adjusted by solvent addition within the range of 500 to 5,000 centipoises, preferably 1,500 to 3,000 centipoises, in order to achieve continuous filaments of uniform diameter. It has been found that the very fluid solutions, i.e., those below 500 centipoises, do not fiberize while solutions with viscosities greater than 5,000 centipoises are not readily extrudable. It appears that with increasing viscosity, there is a greater tendency toward irregularity in the filament diameter. It has been further observed that fibers drawn from solutions of relatively high viscosity tend to break up at isolated points on the take-up spool and/or exhibit undesirable structural variations.

The basic approach which forms the basis of the present invention is a wet spinning technique which involves the extrusion of the starting solution from a small diameter spinneret hole directly into a coagulating or drying liquid bath of a particular composition. While various liquids were investigated as coagulating baths, those found suitable were propanol, methyl alcohol, ethyl alcohol, butyl alcohol, a mixture of ethyl alcohol and propanol (e.g., 30 volume percent propanol, remainder ethyl alcohol) and a mixture of methyl alcohol and acetone (e.g., 15 to 25 volume percent acetone, remainder methyl alcohol). The preferred coagulating bath is propanol. A bath of water was tried unsuccessfully.

In the practice of the invention, the polyamic acid starting solution was contained in a syringe which was activated by a Sage syringe pump. The syringe was connected to one end of an L- or U-shaped tube which was immersed in the coagulating bath. By means of a variable speed motor, metered amounts of the solution were extruded from a small diameter orifice (spinneret) located at the other end of the L or U tube. The extruded filament was wound up on a take-up spool located above the coagulating bath. As the primary function of the coagulating bath appears to be the removal of solvent from the fiber-forming solution, a circulating pump was utilized to prevent concentrations of solvent around the drawing fiber. A level wind mechanism was also used to spool the fibers uniformly. Various spinneret hole sizes from four to eight mils were investigated. With an eight mil diameter spinneret, it was not possible to draw fibers much less than one mil in diameter while the four mil spinneret produced fibers down to approximately 0.2 mil (five microns) in diameter.

It should be noted that in all cases the filament diameter is reduced by either decreasing the solution feed rate or by increasing the fiber drawing speed. Using the apparatus above described under conditions as set forth in the following table, continuous polyamic acid filaments convertible to polyimide were successfully produced in accordance with the present invention.

Table I

Filaments from Polyamic Acid Wet Spun in Propanol

| Example No. | Drawing Speed | Feed Rate | Spinneret Hole Size |
|---|---|---|---|
| 1 | 500 ft/hr | 74 ml/day | 6 mils |
| 2 | 500 ft/hr | 52 ml/day | 6 mils |

Table I-continued

| Filaments from Polyamic Acid Wet Spun in Propanol | | | |
|---|---|---|---|
| Example No. | Drawing Speed | Feed Rate | Spinneret Hole Size |
| 3 | 500 ft/hr | 66 ml/day | 6 mils |
| 4 | 200 ft/hr | 74 ml/day | 6 mils |
| 5 | 200 ft/hr | 37 ml/day | 8 mils |
| 6 | 200 ft/hr | 52 ml/day | 8 mils |
| 7 | 200 ft/hr | 147 ml/day | 6 mils |
| 8 | 200 ft/hr | 147 ml/day | 8 mils |
| 9–11 | 200–300 ft/hr | 174 ml/day | 8 mils |
| 12 | 300 ft/hr | 174 ml/day | 8 mils |

The filaments formed according to the procedures above described were dried and imidized. Drying is accomplished by heating for a time and at a temperature sufficient to remove residual solvent. In the present case, drying was accomplished by heating from room temperature to 50° in a time period of 2 hours in a vacuum of one to 10 millimeters of mercury, then raised from 50° to 90° C in the aforesaid vacuum in one hour and left overnight (i.e., approximately 16 hours). Of course the heating schedule will vary, the smaller diameters fibers (e.g., less than one mil) requiring a much lesser time at temperature. It will be appreciated that while imidization may be carried out in either a vacuum or in air, a vacuum is preferred since it is believed that this assists in removing the residual solvent from the material. Imidization satisfactory to allow subsequent carbonization occurs upon heating to temperatures in the range of approximately 250° to 300° C for at least approximately 15 minutes, preferably 270° to 290° C for at least approximately 30 minutes. Below 250° C, the fiber tends to deform (stretch) during any subsequent carbonization while above 300° C, the imidization leads to the bonding of individual fibers together and/or to the spool.

After the aforesaid thermal imidization, the polyimide filament may be carbonized in order to provide a carbon filament suitable for use as a substrate.

Various polyimide fibers were carbonized and exhibited properties as shown in the following table.

Table II

| Carbonization of Polyimide Filaments | | | | | | |
|---|---|---|---|---|---|---|
| Example | Temperature (° C) | Speed (ft/hr) | Percent Stretch | Diameter Avg. (mils) | UTS Avg. ($\times 10^3$ psi) | E Avg. ($\times 10^6$ psi) |
| 13 | 900 | 20 | 5 | 1 | 113 | 7.2 |
| 14 | 900 | 30 | 5 | .38 | 127 | 5.8 |
| 15 | 900 | 40 | 100 | .50 | 106 | 6.4 |
| 16 | 900 | 60 | 200 | .45 | 90 | 5.9 |
| 17 | 1,150 | 20 | 5 | .92 | 69 | 8.3 |
| 18 | 1,550 | 20 | 5 | .95 | 67 | 7.8 |
| 19 | 1,150 | 20 | 100 | .53 | 113.6 | 6.4 |

The carbon filaments produced are well suited for meeting the requirements for usage as substrates in various coating deposition processes. In one case, for example, a 1.2 mil carbon monofilament having a resistance of 5,000 ohms/in. was utilized as a substrate in an electrically resistive vapor deposition process in which a five mil silicon carbide fiber was produced.

What has been set forth above is intended primarily as exemplary to enable those skilled in the art in the practice of the invention and it should therefore be understood that, within the scope of the appended claims, the invention may be practiced in other ways than as specifically described.

We claim:

1. A process for producing continuous filaments of uniform diameter from polyamic acid suitable for conversion to polyimide filaments by a condensation reaction mechanism comprising:

providing a fiber-forming solution consisting essentially of essentially equimolar amounts of P,P-diaminophenyl ether and bis-(3,4-dicarboxyphenyl) sulfone dianhydride, and an amount of a solvent selected from the group consisting of dimethyformamide, n-methyl pyrrolidone and mixtures thereof sufficient to cause said solution to have a viscosity of 500 to 5,000 centipoises; and forming filaments by extruding said starting solution in a coagulating liquid consisting essentially of a liquid selected from the group consisting of propanol, methyl alcohol, ethyl alcohol, butyl alcohol, a mixture of ethyl alcohol and propanol and a mixture of methyl alcohol and acetone.

2. A process as claimed in claim 1 wherein the coagulating bath consists essentially of propanol.

3. A process as claimed in claim 2 wherein said starting solution has a viscosity of 1,500 to 3,000 centipoises.

4. A process for producing polyimide filaments suitable for conversion to carbon filaments comprising subjecting to thermal imidization a polyamic acid filament produced by the process of claim 3.

* * * * *